United States Patent [19]

Johnson

[11] 4,124,523

[45] Nov. 7, 1978

[54] SILICONE-CONTAINING ACIDIC CLEANER AND CONDITIONER

[75] Inventor: Robert D. Johnson, Midland, Mich.

[73] Assignee: Dow Corning Corporation, Midland, Mich.

[21] Appl. No.: 775,080

[22] Filed: Mar. 7, 1977

[51] Int. Cl.[2] ..... C11D 1/66; C11D 3/14; C11D 7/08; C23G 1/02

[52] U.S. Cl. ..... 252/145; 106/2; 252/142

[58] Field of Search ..... 252/145, 142, DIG. 1, 252/89 R; 134/3, 41; 106/2

[56] References Cited

U.S. PATENT DOCUMENTS

| | | | |
|---|---|---|---|
| 3,214,380 | 10/1965 | Gangwisch | 252/145 X |
| 3,666,559 | 5/1972 | Domicone | 252/142 X |
| 3,681,122 | 8/1972 | Domicone et al. | 106/2 X |
| 3,997,460 | 12/1976 | Sirine et al. | 252/145 X |

FOREIGN PATENT DOCUMENTS

| | | |
|---|---|---|
| 578,717 | 6/1959 | Canada. |
| 843,388 | 6/1970 | Canada. |

*Primary Examiner*—Harris A. Pitlick
*Attorney, Agent, or Firm*—George A. Grindahl

[57] ABSTRACT

Aqueous, acidic compositions are disclosed which consist essentially of polydimethylsiloxane, water, an acid, an abrasive and colloidal silica flocculated with a nonionic surfactant. The compositions are especially useful for cleaning and conditioning smooth siliceous surfaces such as the surfaces of glass-ceramic cooking utensils and appliances.

8 Claims, No Drawings

SILICONE-CONTAINING ACIDIC CLEANER AND CONDITIONER

BACKGROUND OF THE INVENTION

This invention relates to aqueous cleaning and conditioning compositions. In one aspect this invention relates to an improved silicone-containing glass-ceramic cleaner and conditioner. In another aspect this invention relates to acidic cleaning and conditioning compositions having improved workability.

It is well known to include silicone fluids in various cleaning compositions such as window washing solutions, automobile polishes, metal cleaners and fabric cleaners. In particular, abrasive, silicone-containing cleaning and conditioning compositions are taught by Wright in Canadian Pat. No. 578,717, by Hyde in Canadian Pat. No. 843,388 and by Domicone et al. in U.S. Pat. No. 3,681,122. Although the compositions of Hyde and Domicone et al. are effective for cleaning and conditioning glass-ceramic surfaces, such as flat, electric range tops, they are not without deficiencies. For example, while said compositions comprising a soluble, alkali metal silicate are useful for cleaning glass-ceramic surfaces which have been stained during the process of food preparation, the surface still develops a stubborn stain over a period of time. On the other hand, analogous compositions which are free of the soluble, alkali metal silicate are effective for protecting glass-ceramic surfaces without causing further staining but they also lack the cleaning power to remove old stubborn stains.

A cleaning and conditioning composition is desired which is effective as a remover of stains from stained glass-ceramic surfaces and which is also effective as a conditioner of clean glass-ceramic surfaces to prevent or retard the formation of stubborn staining.

It has been found that an effective cleaner and conditioner composition for glass-ceramic surfaces that meets the above criteria can be prepared by mixing an abrasive, a surfactant, an acid and an aqueous emulsion of a polydimethylsiloxane fluid. However, such a mixture has a less-than-optimum workability, tending to dry and cake rapidly during use.

SUMMARY OF THE INVENTION

It is an object of this invention to provide an improved glass-ceramic cleaner and conditioner.

It is another object of this invention to provide an aqueous cleaning and conditioning composition that has an improved resistance to water loss, such as by evaporation and absorption, during use.

These and other objects are realized by the compositions of this invention consisting essentially of an acidic mixture of water, a polydimethylsiloxane fluid, an abrasive and a flocculated silica. One or more additional components, such as thickners, organic solvents, dyes and odorants may also be added to the composition, if desired.

The compositions of this invention provide an improved cleaning action on hard surfaces such as siliceous surfaces such as porcelain, porcelain enamel, glass, ceramic and glass-ceramic, the latter being available as cooking utensils under the tradenames Pyroceram® and Pyroceram Corning Ware®, and metal surfaces such as stainless steel, aluminum, copper and steel and on semi-hard surfaces such as thermoset plastics such as melamine resins, formaldehyde resins and the like. While not wishing to limit the invention by theory, it is believed that this improved cleaning action is the result of a combination of an improved abrasive action which arises from a cooperating effect of the colloidal silica with the abrasive particles, an improved chemical action which arises from the action of an acid, particularly a chelating acid, and an improved wetting action which arises from a cooperating effect of the colloidal silica, the non-ionic surfactant and the water.

With regard to the improved wetting action, the compositions of this invention possess improved workability by way of the composition's ability to resist water loss such as by evaporation or absorption during use thereby making available ample water for workability and cleaning purposes. Thus, in a method for using the compositions of this invention, said composition is applied to the surface to be cleaned and the applied composition is manipulated on the surface using a sponge, towel, brush or the like, and thereafter the excess composition is removed from the cleaned surface. It has been discovered that the compositions of this invention retain the water in the composition and do not become dry and cakey or powdery because of evaporation or absorption of the water into the sponge, towel, brush or the like.

The compositions of this invention also provide an improved conditioning action to said hard and semi-hard surfaces. The surfaces that have been cleaned and conditioned using the compositions of this invention have improved resistance to staining by foreign materials, such as by food, hard water and combinations thereof, compared to the soluble-silicate-containing compositions of the art. Again, while not wishing to limit the invention by theory, it is believed that this improved resistance to staining arises from two features, i.e. from the presence of the polydimethylsiloxane fluid, which serves to occupy tiny pits and cracks in the cleaned surfaces, thereby preventing the deposition of stain and dirt, and from the absence of soluble silicates which, in the use of the compositions of the art, are normally deposited on the clean surface as a hard, but porous layer which serves as a residence for dirt and stain.

DESCRIPTION OF THE INVENTION

This invention relates to an aqueous cleaning and conditioning composition consisting essentially of (a) from 0.1 to 10 weight percent, based on the weight of the composition, of a polydimethylsiloxane fluid having a viscosity of from 0.05 to 200 pascal-seconds at 25° C., (b) from 10 to 50 weight percent, based on the weight of the composition, of an abrasive, (c) a colloidal silica, (d) a non-ionic surfactant in sufficient amount to flocculate the colloidal silica, (e) sufficient acid to provide a pH of less than 4.0 for said composition and, (f) the balance water; the weight ratio of the total amount of water to the total amount of colloidal silica plus non-ionic surfactant having a value of less than approximately 15.

The polydimethylsiloxane fluids useful in the compositions of this invention are well known in the polymer art and have the general formula

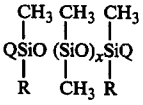

wherein R denotes a monovalent hydrocarbon radical having from 1 to 6 inclusive carbon atoms such as methyl, ethyl, i-propyl, cyclohexyl, vinyl, allyl and phenyl, Q denotes a monovalent radical selected from the group consisting of R radicals and hydroxyl and $x$ has an average value such that the viscosity of the fluid has a value at 25° C. of from 0.05 to 200 pascal-seconds (50 to 200,000 centipoise), preferably in the range of 1 to 10 pascal-seconds.

A preferred polydiorganosiloxane fluid is obtained when each R is methyl and each Q is independently methyl or hydroxyl. That is to say, preferred fluids for the purposes of this invention are methyl-endblocked, hydroxyl-endblocked and methyl- and hydroxyl-endblocked polydimethylsiloxanes and mixtures thereof. It should be noted that suitable silicone fluids of the type mentioned may contain incidental amounts of polydimethylcyclosiloxanes ranging up to 15 percent by weight. The presence of incidental amounts of or the absence of polydimethylcyclosiloxanes is not detrimental to the effectiveness of the compositions of this invention. It should also be noted that polydimethylsiloxanes may frequently contain trace amounts of methylsilsesquioxane siloxane units, the presence or absence of which in the polydimethylsiloxane fluids is not detrimental to the effectiveness of the compositions of this invention.

The polydimethylsiloxane fluid may be present as an emulsion in water or as a liquid suspendable in a suitably thickened composition or as a liquid suspendable in a suitable mixture of water and organic solvent such as lower alkanols. That is to say, the compositions of this invention may be an essentially homogeneous mixture with respect to the polydimethylsiloxane or an essentially heterogeneous mixture which is capable of being rendered essentially homogeneous by physical action, such as by shaking.

Compositions wherein the polydimethylsiloxane is not in the emulsion form may contain suitable thickeners, hereinafter delineated, to provide compositions of this invention which, upon being agitated, will remain essentially homogeneous for a period of time sufficiently long to permit applying and using the compositions.

Preferably the polydimethylsiloxane fluid is present in the compositions of this invention in emulsion form. The polydimethylsiloxane fluid may be emulsified by any suitable method. Thus, it is well known and suitable to prepare a polydimethylsiloxane fluid having a suitable viscosity, hereinbefore delineated, and subsequently prepare an aqueous emulsion of said fluid. Alternately, it is known from U.S. Pat. No. 3,294,725, and suitable, to prepare an aqueous emulsion of a suitable precursor such as a polydimethylcyclosiloxane or a short-chain, low-viscosity polydimethylsiloxane and to subsequently polymerize said precursor in emulsion to provide the emulsified polydimethylsiloxane of suitable viscosity.

It is to be understood that in the preparation of the compositions of this invention the emulsified polydimethylsiloxane fluid may be prepared and then mixed with the other components or the polydimethylsiloxane fluid may be emulsified in the presence of one or more of the other components. Generally, a small amount, for example 0.01 to 1 weight percent, of a suspending agent or emulsifier is used to properly disperse the polydimethylsiloxane fluid in the aqueous phase. Suitable suspending agents and emulsifiers are well known in the synthetic polymer art and include cationic agents such as alkyltrimethyl ammonium halides, anionic agents such as sodium alkylarylsulfonates and non-ionic agents such as polyethylene glycol fatty acid esters.

The amount of polydimethylsiloxane fluid to be used in the compositions of this invention is from 0.1 to 10 percent by weight based on the weight of the total composition. Generally, a desirable amount of said fluid to be used is roughly inversely related to the viscosity of the fluid to be used; the higher viscosity fluids, such as from 50 to 200 pascal-seconds, being present in the lower ranges, such as from 0.1 to 1 percent and the lower viscosity fluids, such as from 0.05 to 50 pascal-seconds, being present in the higher ranges such as from 1 to 10 percent. We have found that preferred values for the viscosity and amount of the polydimethylsiloxane fluid to be used in a composition of this invention is from 1 to 10 pascal-seconds at 25° C. and from 3 to 6 percent by weight, respectively.

The abrasive that is used in the compositions of this invention may be any of the well-known, finely divided abrasives such as diatomaceous earth, aluminum oxide, ground quartz, tripoli and talc. For best results, the abrasive should consist of small particles which are easily dispersed and which demonstrate a safe and efficient abrasive action on the surface to be cleaned.

A suitable amount of abrasive to be used in the compositions of this invention is from approximately 10 to 50 percent by weight based on the total weight of the composition. Compositions of this invention which are to be used for removing encrusted stains, such as carbonized food stains, from glass-ceramic surfaces preferably contain from 20 to 30 percent by weight abrasive, based on the weight of the composition.

The type of colloidal silica that is suitable for use in the compositions of this invention is not critical, i.e. the colloidal silica may be a dry but hydrophilic powder or a hydrated silica associated with various portions of water or a silica aquasol. By colloidal silica it is meant synthetic, amorphous silica having discrete particles, usually spheres or agglomerated spheres, wherein at least one dimension of said particles has a value in the general colloidal range of from 1 nanometer ($n$) to 1 micrometer ($\mu$), more typically from 1 to 500 $n$.

Exemplary of the silica powders suitable for use in the compositions of this invention are the high-surface-area silicas that are produced by well-known fuming and precipitating processes. These silicas may be anhydrous or hydrated to varying degrees and are composed of discrete particles having an average size in the range of from 2 to 50 n. Many are available under tradenames such as Aerosil®, Cab-O-Sil®, Hi-Sil®, Quso and Ultrasil®.

Exemplary of the silica aquasols suitable for use in the compositions of this invention are the well-known colloidal solutions or suspensions of silica particles such as those prepared from soluble silicates by the removal, such as by neutralization with acid, ion-exchange or electrodialysis, of anions such as sodium ions; or prepared by hydrolysis of suitable precursors such as silicate esters or silicon tetrachloride. Included in the above are the silica sols of Bird, U.S. Pat. No. 2,244,325; Bechtold et al., U.S. Pat. No. 2,574,902; Alexander, U.S. Pat. No. 2,750,345; Atkins, U.S. Pat. No. 3,092,173 and Alexander et al., U.S. Pat. Nos. 2,601,235 and 2,605,228. These silica sols are composed of silica particles in sizes ranging upwardly to 200 n. Many are available under tradenames such as Ludox ®, Syton ®, Nalcoag ® and Nyacol ®.

The lower limit of the amount of colloidal silica to be used in the compositions of this invention is determined by the total amount of water in the composition and the amount of non-ionic surfactant that is used to flocculate the colloidal silica. Thus, the weight of water that can be effectively controlled against premature absorptive and/or evaporative loss from the composition is approximately equal to as much as 15 times the combined weight of colloidal silica plus non-ionic surfactant, hereinafter delineated. That is to say, a composition of this invention comprising 60 parts by weight water should comprise at least 4; e.g. 4, 5, 10, 15, 20 and more, parts of flocculated mixture of colloidal silica and non-ionic surfactant. The amount of water to be used in this calculation is the total amount of water in the composition derived from all components. The amount of non-ionic surfactant to be used in the compositions of this invention is merely the amount that will flocculate the colloidal silica as determined by the test hereinafter described.

Any of the well-known non-ionic surfactants may be used in the compositions of this invention. Exemplary of suitable non-ionic surfactants are the polyoxyalkylene compounds of the general formula $R'(CH_2CHRO)_nR''$ wherein R denotes hydrogen or methyl, R' denotes hydroxy, alkoxy, phenoxy, alkylphenoxy, alkylcarboxy, benzoxy, alkylbenzoxy, alkylcarboxamido, polyoxyethylethoxy and polyoxypropylpropoxy, R'' denotes hydrogen, alkyl, phenyl, alkylphenyl, alkoyl, benzoyl, alkylbenzoyl, hydroxyethylpolyoxyethyl and hydroxypropylpolyoxypropyl and *n* is an integer. Included are alkylphenoxypolyoxyethylene glycols available under various tradenames such as Makon ® -10, Triton ® X-100 (isooctyl derivative), Tergitol ® NTX (octyl derivative) and Neutronyx ® 600 (nonyl derivative). Further examples include polyoxyethylene-substituted fatty acid amines available under various tradenames such as Stepanol ® LDA (N,N-di(hydroxyethyl)lauramide), Ethomid ® HT 25 and Ninol AB-21 (N-hydroxyethyllauramide); and other polyoxyethylene-containing proprietary products such as Tween ® 20 (sorbitan polyoxyethylene monolaurate), Renex ® -20 and Nonic ® 218 (polyethylene glycol t-dodecyl thioether).

The amount of non-ionic surfactant to be used in the compositions of this invention is an amount needed to cause flocculation of the colloidal silica. An amount of non-ionic surfactant needed to flocculate a colloidal silica depends upon many factors such as the nature and amount of colloidal silica to be flocculated, the nature of the non-ionic surfactant and the pH of the system. It is also known that flocculation of a particular colloidal silica with a particular non-ionic surfactant occurs to a varying extent over a range of values for the surfactant-/silica ratio, with optimum flocculation occurring over a relatively narrow range of said ratio.

To determine the proper amount of any non-ionic surfactant to use for a given amount of any colloidal silica, the following procedure is used.

A suitable, but known, weight (S) of the non-ionic surfactant to be used is placed in a beaker and its viscosity is measured with a Brookfield viscometer or its equivalent. The surfactant is then treated incrementally with 1/10 S (or smaller) portions of the colloidal silica to be used in the composition and the viscosity of the resulting mixture is measured after each incremental addition. Sufficient silica is added to observe a flocculating and then a deflocculating of the silica, as indicated by a significant increase and then a significant decrease in the viscosity of the mixture of silica and surfactant. The weight ratio of non-ionic surfactant to colloidal silica, expressed as dry silica, is calculated for each mixtue whose viscosity was measured and a graph of viscosity vs. surfactant/silica weight ratio is constructed. A smooth curve is drawn sequentially through the points of the graph to show the range of values and the optimum values for the surfactant/silica ratio that provides flocculated silica for the compositions of this invention. For example, 100 parts of Makon ® -10 is flocculated by 40 parts of an equal weight mixture of Ludox ® HS-30 and water (15 weight percent $SiO_2$) but not by 30 parts of the mixture. Deflocculation occurs with 70 parts, but not 60 parts of the mixture of silica in water. A graph of viscosity vs. surfactant/silica weight ratio shows that flocculation of the diluted Ludox ® HS-30 with Makon ® -10 occurs over a surfactant/silica weight ratio of from approximately 19:1 to 9:1 with maximum flocculation occurring when the surfactant/silica ratio has a value of from 16:1 to 11:1.

The compositions of this invention are acidic, i.e. they have a pH of less than 4.0. It has been found that optimum cleaning action is obtained when the pH of the composition has a value of from 1 to 3. The acidity of the compositions of this invention is established by adding a suitable amount of an acid to the composition. The type of acid to be added is not critical and may be a non-oxidizing inorganic acid such as phosphoric acid and hydrochloric acid or an organic acid such as acetic acid, citric acid and oxalic acid. Optimum cleaning action is obtained with oxalic acid and phosphoric acid at a pH of from 1.0 to 1.5, with acetic acid and citric acid at a pH of approximately 2.5 and with hydrochloric acid at a pH of approximately 3.5. The optimum pH for any given mixture of components and type of acid should be determined by routine experimentation.

It has also been observed that better cleaning action of stained glass-ceramic surfaces is obtained when the acid in the compositions of this invention is a chelating acid such as oxalic acid, citric acid, malonic acid, ethylenediaminetetraacetic acid and succinic acid. Citric acid is also a preferred acid when the compositions of this invention are to be used on surfaces related to food preparation for human consumption.

Any of the well-known thickeners may be used in the compositions of this invention. Exemplary of suitable thickeners are cellulose derivatives, bentonite clays, natural gums and the like. The amount of a thickener to be used in the compositions of this invention may be determined by simple experimentation and is merely the amount needed to accomplish the desired thickening of the composition and/or dispersing of polydimethysiloxane oil, hereinbefore detailed.

The compositions of this invention may be prepared by any suitable method. Preferably the flocculated mixture of colloidal silica and non-ionic surfactant is admixed to a mixture of water, abrasive and any non-essential components such as thickeners, dyes and odorants and the polydimethylsiloxane fluid, neat, emulsified or suspended in water is added to the resulting mixture. Finally, the total mixture is acidified to the desired pH with a suitable amount of acid.

As noted above, the compositions of this invention possess improved vorkability because they do not premature;ly dry and cake during use. It has been found that a qualitative relationship exists between the work time of the compositions, i.e. the time during which an applied composition can be manipulated during a cleaning method before it becomes cakey or powdery, and the retention time of water in a sample of the composition that is placed on a paper towel. The higher the retention time, the higher the work time.

For the purposes of this invention, the retention time is determined by the following test. Approximately one gram of sample is placed in a circular blob on a single two-ply cellulose towel (Scott® utility-wipes TM 05322, Type 590) and the time required for liquid to wick outwardly to a distance of ⅛ inch from the perimeter of the blob is noted as the retention time.

The following examples are included to enable those skilled in the art of aqueous cleaning and conditioning compositions to more easily practice the invention. All parts are parts by weight.

EXAMPLE 1

A control composition was prepared which consisted essentially of 4.9 percent of an emulsion-polymerized polydimethylsiloxane fluid having a viscosity of 5 pascal-seconds at 25° C., 0.3 percent of a quaternary ammonium salt (Ammonyl® 27) as an emulsifier, 22 percent of a diatomaceous earth (Celite® 560) as an abrasive, 0.9 percent of a non-ionic surfactant (Triton® X-100), 4.9 percent of a magnesium montmorillonite (Ben-A-Gel® EW) as a thickener, 3.7 percent citric acid, a trace of dye and 63.3 percent water. A composition of this invention was prepared by admixing, with 100 parts of the control composition, 8.6 parts of a flocculated mixture of colloidal silica and non-ionic surfactant, said flocculated mixture consisting of one part of colloidal $SiO_2$, 2.4 parts of water (i.e. 3.4 parts of Ludox® HS-30) and 5.2 parts of alkylphenoxypolyoxyethylene ethanol (Makon® -10). The surfactant/silica ratio in the final composition of this invention was 6.1:1.0 and the ratio of water to surfactant plus silica was 65.7:7.1 = 9.25:1.0.

The control sample and the composition of this invention were tested for retention time of water as described by the test hereinabove delineated. The control sample had a retention time of 7 seconds and the composition of this invention had a retention time of 120 seconds.

EXAMPLE 2

When 100 parts of Sears® Smooth Top (22 85704) cleaner and conditioner was mixed with 8.0 parts of the clocculated silica mixture of Example 1, its retention time was increased from 6 seconds to 90 seconds. Sears® Smooth Top is believed to be 7.4 percent polydimethylsiloxane fluid, 22.6 percent abrasive, 1.4 percent oxalic acid, 43.6 percent water and 25 percent mineral spirits. The mixture with the flocculated silica mixture is therefore believed to be 6.9 percent polydimethylsiloxane, 20.9 percent abrasive, 0.9 percent colloidal silica, 4.4 parts of non-ionic surfactant, 1.3 percent oxalic acid, 42.4 percent water and 23.1 percent mineral spirits, and further is believed to have a surfactant/silica ratio of 4.4:0.9 = 4.9:1.0 and a water/surfactant plus silica ratio of 42.4:5.3 = 8:1.

EXAMPLE 3

To each of 4 portions of approximately 25 parts of water was added, with mixing, 1.3 parts of Ben-A-Gel® EW, 4.83 parts of Makon® -10, 3.8 parts of Ludox® HS-30 and 20.8 parts of Celite® 560. To the well-mixed mixture was added 12 parts of an emulsion polymerized polydimethylsiloxane fluid emulsion which was 38 percent fluid, 54.6 percent water and 7.4 percent Ammonyx® 27, followed by one of the following combinations: 4.77 parts of hydrochloric acid and 27.50 parts water (Composition A); 0.80 parts phosphoric acid and 31.47 parts water (Composition B); 3.00 parts oxalic acid and 29.27 parts water (Composition C); or 2.50 parts citric acid and 29.77 parts water (Composition D). Each of the resulting compositions of this invention (A, B, C, and D) and a prior art composition (E) was used to clean and condition a glass-ceramic surface electric range according to the following procedure.

A staining mixture of ground beef, eggs, tapioca pudding, cherries, cheese, milk, sugar, salt, tomato sauce, pepper and flour was applied to the burner portion of an unused 4-element Corning® Cooktop. An aluminum pan of water was placed over the applied staining mixture and the burner was turned on high for 15 minutes. The burner was then turned off and the Cooktop was allowed to cool for 10 minutes with the pan in place. The pan of water was then removed and the Cooktop was allowed to cool to room temperature. Loose crust was scraped away and the residue and stain was cleaned with one of the compositions described above. This procedure was repeated 10 times for each composition and the appearance of any unremovable stain was noticed. The results are summarized in Table I. The control composition (E) was a prior art composition consisting essentially of 25 parts of Celite® 560, 1 part of Triton® X-100, 58.5 parts of water, 14 parts of the above-described emulsion polymerized polydimethylsiloxane emulsion, 0.4 part of Carbopol® 941 as a thickener and 1.05 parts of sodium metasilicate.

This example demonstrates the superior cleaning and conditioning properties of the compositions of this invention compared to the prior art, soluble-silicate-containing compositions. This example also demonstrates the benefit of using a chelating acid such as in Compositions C and D compared to a non-chelating acid such as in Compositions A and B.

TABLE I

| Composition No. (Acid Used/pH) | Stain Intensity* After Cleaning Cycle No. 1 | 2 | 3 | 4 | 5 | 6 | 7 | 8 | 9 | 10 |
|---|---|---|---|---|---|---|---|---|---|---|
| A. ($HCl$/2.0) | N | N | N | N | N | N | VL | VL | L | L |
| B. ($H_3PO_4$/1.0) | N | N | N | N | N | N | N | VL | VL | VL |
| C. ($H_2C_2O_4$/1.0) | N | N | N | N | N | N | N | N | VL | VL |
| D. ($H_3C_6H_5O_7$/2.5) | N | N | N | N | N | N | N | N | VL | VL |
| E. (Prior Art-Control) | M | M | M | H | H | H | H | VH | VH | VH |

*N = None,
VL = Very Light,
L = Light,
M = Moderate,
H = Heavy,
VH = Very Heavy

EXAMPLE 4

A very heavily stained Corning® Cooktop was repeatedly cleaned with Composition D of Example 3 according to the following procedure. An aluminum pan of water was heated for 15 minutes on the stained burner area, allowed to cool for 10 minutes and then removed. After the Cooktop had cooled to room temperature, it was cleaned with Composition D and the residual stain intensity was noted. The very heavy initial stain was reduced to a heavy stain by the second cleaning, a moderate stain by the fifth cleaning, and a light stain by the ninth cleaning.

This example demonstrates the cleaning ability of the compositions of this invention.

That which is claimed is:

1. An aqueous cleaning and conditioning composition consisting essentially of (a) from 0.1 to 10 weight percent, based on the weight of the composition, of a polydimethylsiloxane fluid having a viscosity of from 0.05 to 200 pascal-seconds at 25° C., (b) from 10 to 50 weight percent, based on the weight of the composition, of an abrasive, (c) a colloidal silica, (d) a non-ionic surfactant in sufficient amount to flocculate the colloidal silica, (e) sufficient acid to provide a pH of less than 4.0 for said composition and (f) the balance water, the weight ratio of the total amount of water to the total amount of colloidal silica plus non-ionic surfactant having a value of less than approximately 15.

2. A composition according to claim 1 wherein the polydimethylsiloxane fluid is emulsified in water.

3. A composition according to claim 2 wherein the colloidal silica is flocculated from aqueous suspension.

4. A composition according to claim 3 wherein the abrasive is a diatomaceous earth and is present in from 20 to 30 weight percent.

5. A composition according to claim 4 wherein the polydimethylsiloxane fluid has a viscosity of from 1 to 10 pascal-seconds at 25° C. and is present in from 3 to 6 weight percent.

6. A composition according to claim 5 wherein a thickener is present.

7. A composition according to claim 6 wherein the acid is a chelating acid.

8. A composition according to claim 7 wherein the acid is citric acid.

* * * * *

UNITED STATES PATENT AND TRADEMARK OFFICE

CERTIFICATE OF CORRECTION

PATENT NO. : 4,124,523

DATED : November 7, 1978

INVENTOR(S) : Robert D. Johnson

It is certified that error appears in the above-identified patent and that said Letters Patent are hereby corrected as shown below:

Column 6, line 66, "vorkability" should read --workability--

Column 6, line 67, "premature;ly" should read --prematurely--

Column 7, line 50, "clocculated" should read --flocculated--

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*